United States Patent [19]

Moore

[11] Patent Number: 4,585,915

[45] Date of Patent: Apr. 29, 1986

[54] CONTAINERS WITH ATTACHED LID FOR STORAGE AND MICROWAVE COOKING

[75] Inventor: Michael A. Moore, Alhambra, Calif.

[73] Assignee: The Dow Chemical Company, Midland, Mich.

[21] Appl. No.: 728,414

[22] Filed: Apr. 29, 1985

[51] Int. Cl.[4] ..... H05B 6/80

[52] U.S. Cl. ..... 219/10.55 E; 99/DIG. 14; 426/243; 426/114; 426/115; 220/69

[58] Field of Search ..... 219/10.55 E, 10.55 F, 219/10.55 R; 99/DIG. 14, 451; 426/241, 243, 234, 107, 111-115; 220/69; 206/349, 372; 312/DIG. 33

[56] References Cited

U.S. PATENT DOCUMENTS

| | | | |
|---|---|---|---|
| 1,779,159 | 10/1930 | Coe | 206/349 X |
| 3,071,307 | 1/1963 | Keller | 426/113 X |
| 4,143,165 | 3/1979 | Daswick | 426/113 |
| 4,189,054 | 2/1980 | Liu et al. | 426/115 X |
| 4,317,017 | 2/1982 | Bowen | 219/10.55 E |

*Primary Examiner*—Philip H. Leung

*Attorney, Agent, or Firm*—L. E. Hessenaur, Jr.

[57] ABSTRACT

A container is provided for freeze storing and subsequent microwave heating and serving of food products. The cover is made of plastic or other suitable material transparent to electromagnetic radiation. The container includes a base having a flat bottom thereon on which the container may rest. The base is upwardly open and has an upper edge with an outwardly projecting rim. Two cover portions are pivotally mounted on the base and have lower edges with inwardly directing flanges interfitting with the rim of the base to seal the cover portions to the base. The cover portions seal to one another by structure such as a tongue and groove joint, and structure is provided for releasably holding the cover portions in closed position.

9 Claims, 9 Drawing Figures

CONTAINERS WITH ATTACHED LID FOR STORAGE AND MICROWAVE COOKING

BACKGROUND OF THE INVENTION

Frozen foods which may comprise complete dinners, or main courses or desserts, have become quite common. Such frozen foods must be heated for use in most cases. As frozen foods were developed it was common to package them in aluminum containers. However, more recently microwave ovens have become popular for quick heating of frozen foods. The usual metal containers cannot be used in microwave ovens.

Accordingly, progress has been made in providing containers of plastic or paper-like material so that the frozen foods can be transferred directly from the freezer into a microwave oven for heating therein without the necessity of changing containers. However, the containers now in use are by and large not adapted for use at the table. Thus, it is necessary to remove the heated frozen food from the supply container to place it on a plate in the kitchen, or on a serving dish of some sort that can be carried from the kitchen to the dining room. It would be desirable to avoid this step, i.e., to provide a frozen food container that could be used for heating the food therein in a microwave oven, and then would be sufficiently attractive and adapted for placement on the dining table so as to avoid the necessity of transferring food except at the final stage from the serving dish onto a diner's plate.

OBJECTS AND SUMMARY OF THE PRESENT INVENTION

It is an object of the present invention to provide a container for merchandising of frozen food, which container with the frozen food therein can be placed in a microwave oven for heating of the food, and which container is sufficiently attractive that it can be placed directly on a dining table for serving of the food therein.

More particularly, it is an object of the present invention to provide a container for frozen food which is adapted for placement in a microwave oven for heating of the food, which container is provided with a two-part cover hingedly mounted on a base for exposing the food subsequent to heating so that it may be served from the container, preferably directly at a dining table.

In attaining the foregoing and other objects and advantages of the present invention I provide a three-piece container molded of a suitable plastic material which is transparent to electromagnetic radiation such as any microwave oven. The container may be of clear plastic so that the food therein can be viewed, or it may be of opaque or translucent plastic, or the bottom portion alone may be opaque or translucent with the cover portions transparent The base is semi-cylindrical in shape, having substantially flat ends, and having a chordal flat on the bottom so that the container may be placed on a supporting surface without tipping or rocking. Two cover portions are pivotally mounted on the base by means of integral dimples and recesses and suitably interfit with the base and with one another to provide a sufficient seal. The cover portions are generally quarter cylindrical in shape having substantially flat ends, and further having substantially chordal flat portions thereon so that the container may be placed in upright, food serving position with the cover portions wide open, and with the container free from tipping or rocking. Means is provided for releasably holding the cover portions in closed position, which means is suitable for passing through a microwave oven without damage to any part of the container or of the oven.

THE DRAWINGS

The present invention will best be understood with reference to the following specification when taken in connection with the accompanying drawings wherein.

DETAILED DISCLOSURE OF THE ILLUSTRATED EMBODIMENT

Figures 1, 2, 3, 4, 5, 6, 7, 8, 9:
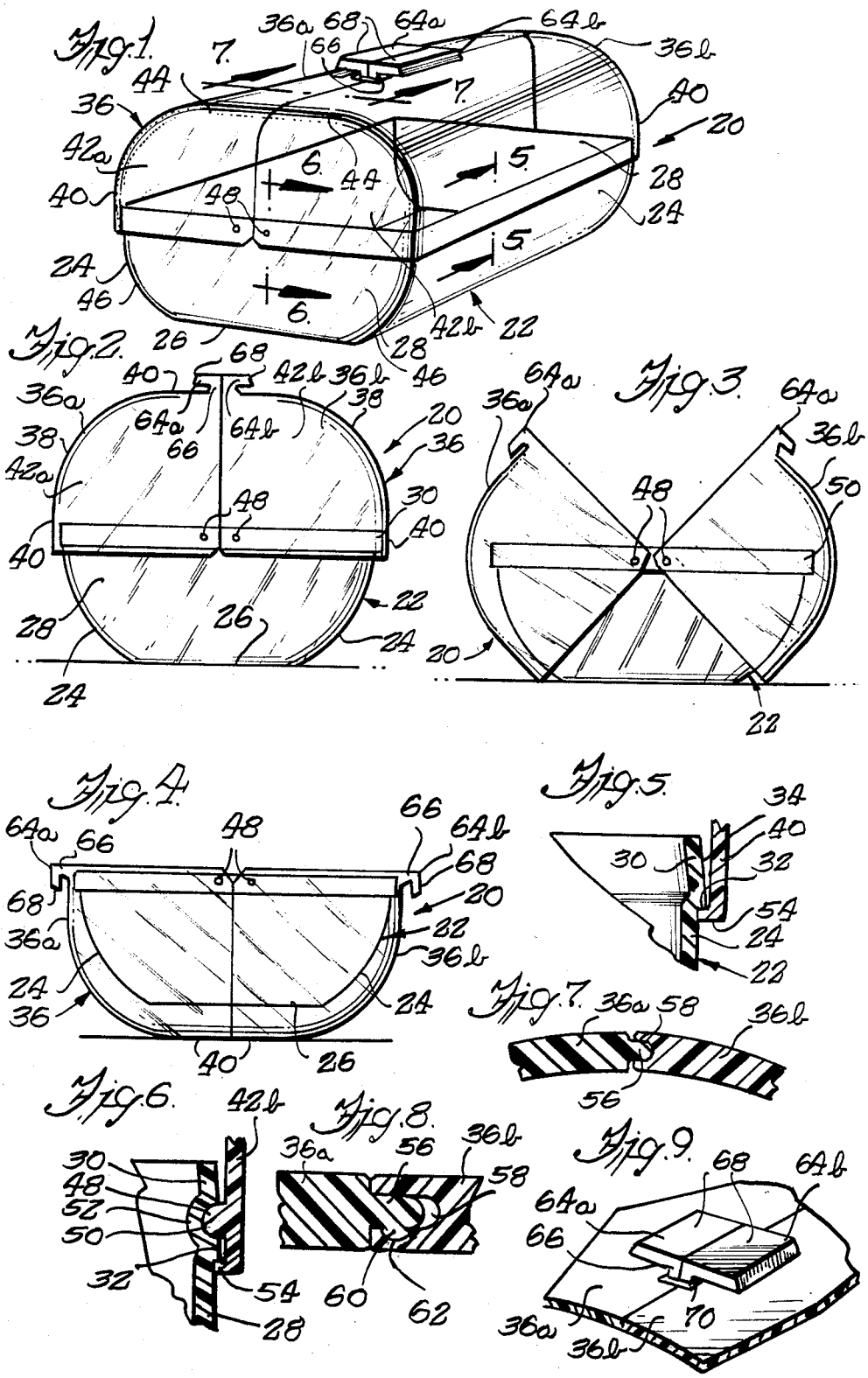
FIG. 1 is a perspective view of the container constructed in accordance with the present invention.
FIG. 2 is an end view thereof.
FIG. 3 is an end view similar to FIG. 2 with the cover partially open.
FIG. 4 is a view similar to FIG. 2 with the cover completely open.
FIG. 5 is a fragmentary longitudinal sectional view on an enlarged scale as taken substantially along the line 5—5 in FIG. 1.
FIG. 6 is a fragmentary sectional view on an enlarged scale taken substantially along the line 6—6 in FIG. 1.
FIG. 7 is a fragmentary cross-sectional view on an enlarged scale taken substantially along the line 7—7 in FIG. 1.
FIG. 8 is a view similar to FIG. 7 on a further enlarged scale showing a modification.
FIG. 9 is a fragmentary perspective view of the handle portion of the container showing an alternative structure for holding the cover in closed position.

Turning now to the drawings in greater particularity, and first to FIGS. 1–4, there will be seen a container 20 constructed in accordance with the present invention. The container is molded of a suitable plastic material or other substance which is transparent to electromagnetic radiation. The container includes a base 22 which is partially semi-cylindrical in construction, having curved walls 24, and also a chordal flat 26 so that the container may rest on a flat surface without the container tipping or rocking. The base is open at the top, provided with end walls 28 which conveniently are substantially flat and perpendicular to the axis of the semi-cylindrical base 22. The walls may be curved outwardly so as to be concave into the base.

Near its top edge the base 22 is offset outwardly to provide a peripheral flange 30 having at its lower edge an external substantially right-angle shoulder 32. The flange is preferably slightly smaller at its upper edge so that the outer surface thereof tapers slightly downwardly and outwardly to the shoulder 32, whereby to prevent undue friction with a cover or lid portion to be described hereinafter. It will be understood that the base is intended to be filled with a frozen food product extending to substantially the upper edge of the base. Such food product can most conveniently be placed in the base prior to freezing thereof, and frozen in the base.

The container 20 is provided with a cover 36 comprising two mirror image cover portions **36*a* and 36*b*. The cover 36 is shaped generally similarly to the base, being substantially semi-cylindrical, having curved surfaces 38, and further having a substantially chordal flat 40 at the top portion thereof (with the cover closed), and with tangential or chordal flat portions 40** adjacent the lower edges.

The cover portions **36*a* and 36*b* are provided with substantially flat end walls 42*a* and 42*b*, which may be rounded or curved at 44 into adjacent walls of the cover portions. When such curvature is provided, the end walls 28 of the base may be rounded or curved at 46 to provide appropriate clearance. The cover portions are hingedly or pivotally mounted on the base by means of inwardly directed protuberances 48 (see also FIG. 6) near the inner lower corners thereof, and which are substantially hemispherical in nature. The protuberances 50 may or may not be accompanied by corresponding depressions in the outer surfaces of the end walls. The protuberances are received in corresponding hemispherical recesses 50 in the flanges 30 at the top edges of the walls 28. These depressions preferably are accompanied by inwardly protrusions 52** in the flange portion of the end walls.

The cover portions, both in the end walls 42, and in the side walls 40 are provided with a continuous, inwardly directed flange 54 (FIGS. 5 and 6) which fits beneath the shoulder 32 of the base of the container. This provides a seal between the cover and the base. If necessary, a soft sealing material may be provided on the upper surface of the flange. Further sealing between the cover portions 36*a* and 36*b* is provided in that the confronting edges thereof are provided with a tongue 56 projecting from one of the edges and received in a groove 58 in the confronting edge. As shown in FIG. 8 the tongue may have one or more protuberances 60 received in lateral recesses 62 of the groove 58 to lock the cover portions in closed position. Alternatively, the tongue could be somewhat bulbous and the recess enlarged.

Adjacent the top portion of the cover members 36*a* and 36*b* in close position there is provided cooperating handle members 64*a* and 64*b*. Each of these handle members comprises an upstanding base portion 66, and outwardly extending flanges 68. With the cover portions in closed position the base portions 66 of the handles lie flush against one another, as do the inner aspects of the flanges 68. As an alternative to the protuberance 60 or other enlargement of FIG. 8 a rubber band 70 may be placed about the handles, underlying the flanges 68 and abutting the base portions 66 as shown in FIG. 9.

The container 20 is sold with frozen food in the base thereof with the cover portions in close position as shown in FIGS. 1 and 2. The container and frozen food may be stored for an extended period of time in a freezer, and then removed and placed in a microwave oven for heating of the food without damage to the container or to the microwave oven. Subsequently, when it is desired to serve the food, the container may be placed on a table and the cover portions partially opened as shown in FIG. 3. Preferably, however, the cover portions are moved to full open position as shown in FIG. 4. In this position the base of the container is spaced upwardly from the supporting table, the cover portions being slightly larger than the base as best seen in FIGS. 3 and 4. Thus, even if the food in the base is rather hot, no damage is done to the table due to the spacing of the base up from the table with the container resting on the flat walls 40 of the cover portions.

The specific example of the invention as herein shown and described is for illustrative purposes only. Various changes in structure will no doubt occur to those skilled in the art and will be understood as forming a part of the present invention insofar as they fall within the spirit and scope of the appended claims.

The invention is claimed as follows:

1. A container for freeze storing and subsequent microwave heating and serving of food products made of material transparent to electromagnetic radiation and comprising a base of substantially semi-cylindrical configuration of predetermined radius having closed ends and having a chordally flat bottom on which said container may rest, said base being upwardly open and having an upper edge with an outwardly projecting rim, and two cover portions each of substantially cylindrical configuration of greater radius than said predetermined radius with closed ends, said cover portions being respectively pivoted to said base and having lower edges with inwardly directed flange means interfitting with said rim to seal said cover portions to said base, said cover portions having mutually confronting edges with cooperating means for sealing said cover portions to one another, said cover portions being pivotable from a position overlying and closing said base to a position underlying said base.

2. A container as set forth in claim 1 wherein the confronting edges of the cover are provided with tongue and groove structures for sealing the cover portions to one another.

3. A container as set forth in claim 1 wherein said cover portions are provided with flat surfaces for supporting said container on a table or the like with said cover portions in open position.

4. A container as set forth in claim 3 wherein the confronting edges of the cover are provided with tongue and groove structures for sealing the cover portions to one another.

5. A container as set forth in claim 1 and further including means on said cover portions for holding said cover portions in closed position.

6. A container as set forth in claim 5 wherein confronting edges of said cover portions provide a tongue and groove joint for sealing the cover portions together, said tongue and groove joint at least in part providing an interference fit to hold said cover portions in closed position.

7. A container as set forth in claim 5 wherein the means for holding the cover portions in closed position comprises upward projections on said cover portions and a band encircling said upward projections.

8. A container as set forth in claim 7 wherein said cover portions are provided with handles.

9. A container for freeze storing and subsequent microwave heating and serving of food products made of material transparent to electromagnetic radiation and comprising a base of substantially semi-cylindrical configuration of predetermined radius having closed ends and having a chordally flat bottom on which said container may rest, said base being upwardly open and having an upper edge with an outwardly projecting rim, and two cover portions each of substantially cylindrical configuration of greater radius than said predetermined radius with closed ends, said cover portions being respectively pivoted to said base and having lower edges with inwardly directed flange means interfitting with said rim to seal said cover portions to said base, said cover portions having mutually confronting edges with cooperating means for sealing said cover portions to one another, said cover portions having flat surfaces for supporting said container on a table or the like with said cover portions in open position, the flat surfaces of the cover portions being spaced below the flat bottom of said base for spacing said base above a supporting table or the like.

* * * * *